US008248319B2

(12) United States Patent
Hwang

(10) Patent No.: US 8,248,319 B2
(45) Date of Patent: Aug. 21, 2012

(54) BROADBAND CIRCULARLY-POLARIZED SPIDRON FRACTAL ANTENNA

(75) Inventor: Keum-Cheol Hwang, Seoul (KR)

(73) Assignee: Dongguk University Industry-Academic Cooperation Foundation, Seoul (KR)

( * ) Notice: Subject to any disclaimer, the term of this patent is extended or adjusted under 35 U.S.C. 154(b) by 363 days.

(21) Appl. No.: 12/578,846

(22) Filed: Oct. 14, 2009

(65) Prior Publication Data

US 2010/0090918 A1 Apr. 15, 2010

(30) Foreign Application Priority Data

Oct. 14, 2008 (KR) ..... 10-2008-0100498

(51) Int. Cl.
*H01Q 13/00* (2006.01)

(52) U.S. Cl. ..... 343/767; 343/700 MS; 343/846

(58) Field of Classification Search ..... 343/767, 343/700 MS, 846
See application file for complete search history.

(56) References Cited

U.S. PATENT DOCUMENTS 4,847,625 A * 7/1989 Dietrich et al. ..... 343/700 MS
2002/0175874 A1* 11/2002 Eason ..... 343/770
2008/0094297 A1* 4/2008 Petkov et al. ..... 343/767

OTHER PUBLICATIONS

Jeun-Wen Wu, 2.4/5-GHz Dual-Band Triangular Slot Antenna with Compact Operation, Microwave and Optical Technology Letters, vol. 45, No. 1, Apr. 5, 2005, pp. 81-84.*

* cited by examiner

*Primary Examiner* — Dieu H Duong
(74) *Attorney, Agent, or Firm* — Grossman Tucker Perreault & Pfleger, PLLC

(57) ABSTRACT

A broadband circularly-polarized spidron fractal antenna is disclosed. The broadband antenna of the present invention can realize a bandwidth exceeding 70% without using a multilayer substrate to implement the broadband properties, by forming a geometric structure of a slot, i.e., a spidron fractal, which has not been used in the conventional antennas, on the ground surface of the antenna. The present invention can also induce the radiation properties of a circularly-polarized wave from the properties of the spidron fractal shape, without employing an additional secondary circuit such as a phase distribution circuit for implementing the circularly-polarized wave. Due to such properties described above, the present invention can implement a small broadband circularly-polarized antenna that costs less to manufacture.

6 Claims, 6 Drawing Sheets

(a) (b)

BROADBAND CIRCULARLY-POLARIZED SPIDRON FRACTAL ANTENNA

CROSS-REFERENCE TO RELATED APPLICATIONS

This application claims the benefit of Korean Patent Application No. 10-2008-0100498, filed with the Korean Intellectual Property Office on Oct. 14, 2008, the disclosure of which is incorporated herein by reference in its entirety.

BACKGROUND

1. Field

The following description relates to a broadband antenna, more specifically to a broadband circularly-polarized fractal antenna.

2. Description of the Related Art

An antenna is a transducer that is designed to efficiently radiate electromagnetic waves in space for wireless communication or to efficiently maintain an electromotive force by the electromagnetic waves, and is an apparatus for transmitting or receiving electromagnetic waves in the space for transmission.

Among various types of antennas, the microstrip patch antenna is a popular antenna type and has useful applications in various microwave communications because it is small, light and thin and is simple to fabricate so that mass production may be possible.

However, since the microstrip patch antenna has a narrow impedance bandwidth of around 1 to 2%, it may be difficult to implement a broadband circularly-polarized antenna by using such microstrip patch components.

In order to implement a broadband circularly-polarized antenna by using the microstrip patch component, the conventional technology has proposed that a phase distribution circuit is coupled and a multilayer substrate is used. However, since the conventional technology employs coupling of an additional circuit and use of a multilayer substrate, resulting in decreased efficiency due to the increase in the volume of the antenna and the increase in the cost of production.

SUMMARY

Exemplary embodiments may provide a small broadband circularly-polarized antenna that is inexpensive to manufacture.

In one general aspect, a broadband circularly-polarized antenna includes a dielectric substrate, a ground surface, which is formed on an upper part of the dielectric substrate, a slot, which is formed in the shape of a spidron fractal and in which the slot is formed in the ground surface, and a microstripline, which feeds the spidron fractal slot of the ground surface through the substrate.

Also, the slot in the shape of a spidron fractal can be formed in such a way that a reduction ratio of each isosceles triangle forming the spidron fractal shape is $1/\sqrt{3}$.

Also, the slot in the shape of a spidron fractal can be structured in such a way that a same isosceles triangle is repeatedly coupled to another at least twice.

Also, a height of the microstripline can be 23 unit lengths, and a distance between a center of the microstripline and a point at which a vertex of a first isosceles triangle and a vertex of a second isosceles triangle meet each other can be 17 unit lengths. Here, the first isosceles triangle and the second isosceles triangle form the spidron fractal.

Also, a radiation component can be formed in the shape of a square, one side of which can be 40 unit lengths, and a width of the microstripline can be 3.4 unit lengths.

Additional aspects and advantages of the present invention will be set forth in part in the description which follows, and in part will be obvious from the description, or may be learned by practice of the invention.

DETAILED DESCRIPTION

A broadband circularly-polarized spidron fractal antenna according to a certain embodiment of the present invention will be described below in more detail with reference to the accompanying drawings.

Figure 1:
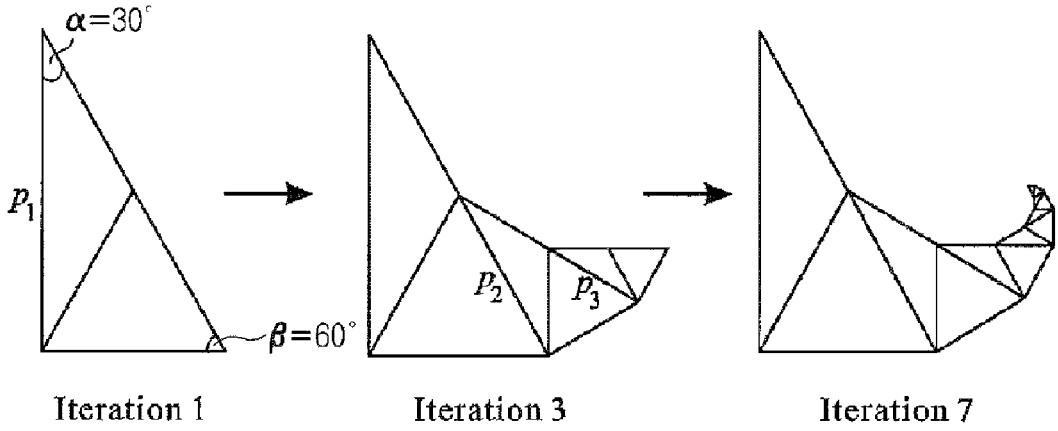
FIG. 1 illustrates a spidron fractal structure of the present invention.

FIG. 1 illustrates a spidron fractal structure according to an embodiment of the present invention. Referring to FIG. 1, the fractal structure is a fragmented geometric shape in which a certain unit shape is repeated infinitely as it curves. Some typical properties of the fractal structure include self-similarity and recursiveness.

The spidron is a continuous geometric shape that consists of isosceles triangles, where, for every pair of joining triangles, each has a side of the other as one of its sides. As illustrated in Iteration 1 of FIG. 1, an antenna according to an embodiment of the present invention has an isosceles triangle having two equal angles of 30 degrees and another isosceles triangle having two equal angles of 60 degrees coupled to each other in an alternating manner. With this configuration, a spidron shape of right triangles having internal angles of 30 degrees and 60 degrees are continuously coupled to one another to form the antenna.

The structure illustrated in Iteration 3 of FIG. 1 represents a structure in which the right triangle illustrated in Iteration 1 of FIG. 1 is repeatedly coupled to another three times. That is, one side of a reduced-size copy of the right triangle of Iteration 1 is coupled to the hypotenuse of the right triangle of Iteration 1, and then a further reduced-size copy, which is reduced at the same scale of the previous one, of the right triangle of Iteration 1 is coupled to the hypotenuse of the reduced-size copy of the right triangle of Iteration 1 in a similar manner. The structure illustrated in Iteration 7 of FIG. 1 is a structure in which the right triangle of Iteration 1 is repeatedly coupled to another seven times.

In the present invention, it is preferable that, in the example illustrated in FIG. 1, a slot of the spidron fractal structure is formed in such a way that the reduction ratio of the two equal sides of each isosceles triangle satisfies $$\frac{P_{n+1}}{P_n}(\text{reduction ratio}) = 1/\sqrt{3},$$

and a same isosceles triangle is repeatedly coupled to another at least twice.

Figure 2:
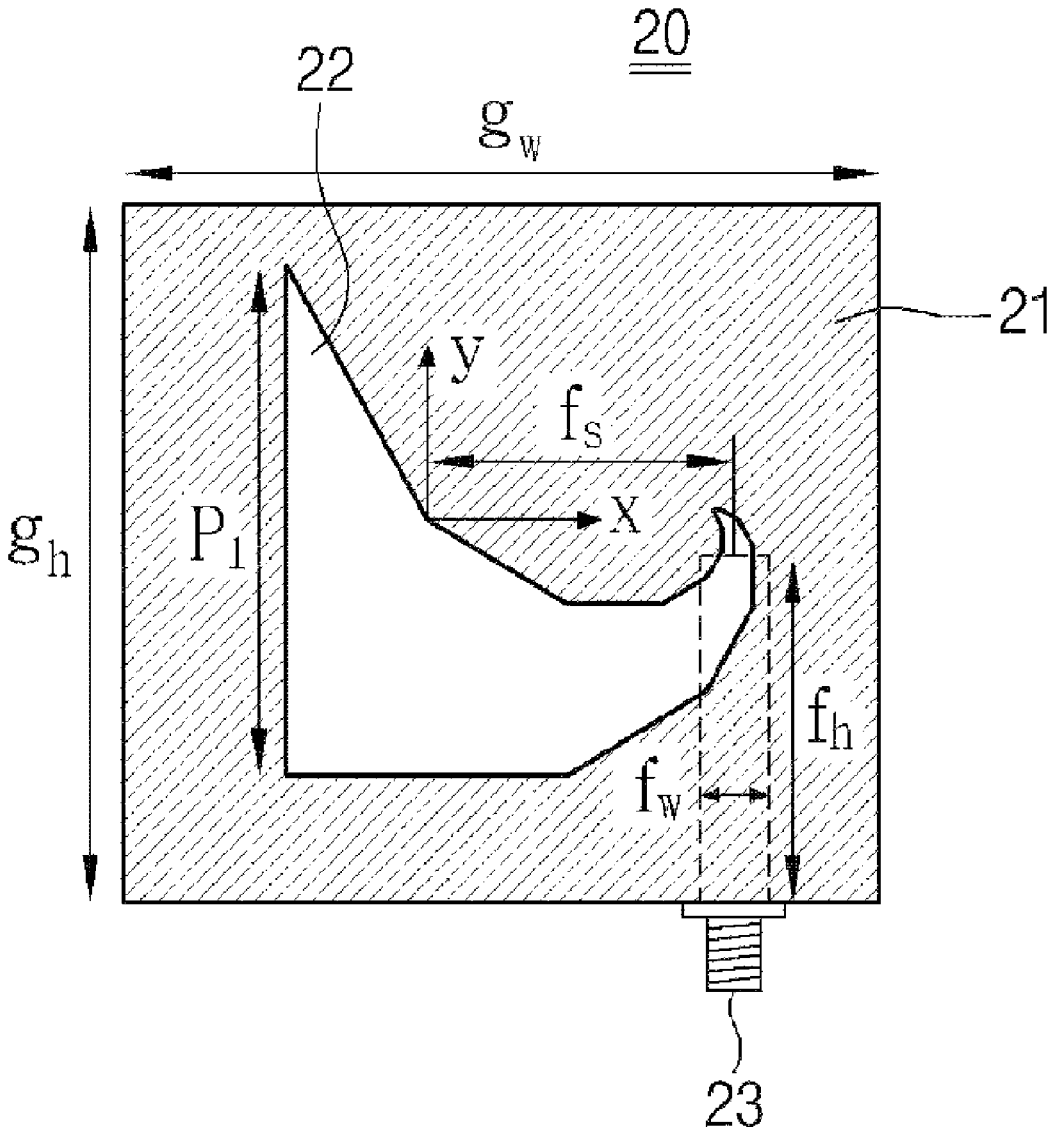
FIGS. 2 and 3 are a plan view and a cross-sectional view, respectively, each of which illustrates a spidron fractal structure of a broadband circularly-polarized antenna in accordance with an embodiment of the present invention.
Figure 3:
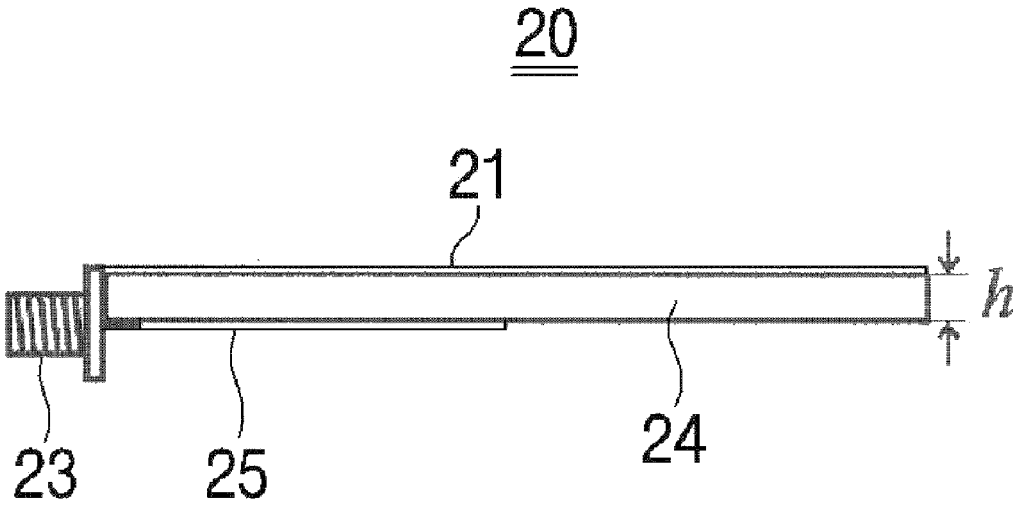

FIGS. 2 and 3 are a plan view and a cross-sectional view, respectively, each of which illustrates a spidron fractal structure of a broadband circularly-polarized antenna in accordance with an embodiment of the present invention. Referring to FIGS. 2 and 3, an antenna 20 according to an embodiment of the present invention includes a ground plane 21 with height $g_h$ and width $g_w$ that is formed on an upper surface of a dielectric substrate 24. The antenna 20 also includes a slot 22 being formed in the shape of a spidron, like the one illustrated in FIG. 1, which is formed inside the ground plane 21.

A 50Ω microstripline 25 is also formed on the other surface of the dielectric substrate 24. The 50Ω microstripline 25, which has height $f_h$ and width $f_w$, performs a function of a feeding line. The microstripline 25 has its center located at a place separated by distance fs in the direction of x-axis from the point where the vertex of the first isosceles triangle and the vertex of the second isosceles triangle of the spidron structure meet each other.

Here, an RF-35 substrate or a PCB substrate such as a glass epoxy (FR-4), can be used as the dielectric substrate 24. In one possible embodiment of the present invention, an RF-35 substrate with a thickness of 1.52 mm and a relative dielectric constant of 3.5 can be used as the dielectric substrate 24.

After the results of performing a number of experiments by adjusting the above-described variables show that optimal resonance frequency band, axial ratio and radiation pattern are obtained when $f_s$=17 mm and $f_h$=23 mm. At this time, it can be seen that $g_w$ and $g_h$ are 40 mm, $p_1$ is 30 mm, and $f_w$ is 3.4 mm.

Also, an SMA connector 23 is connected to the microstripline 25 and the ground surface 21 by being adhered to the dielectric substrate 24.

Figure 4:
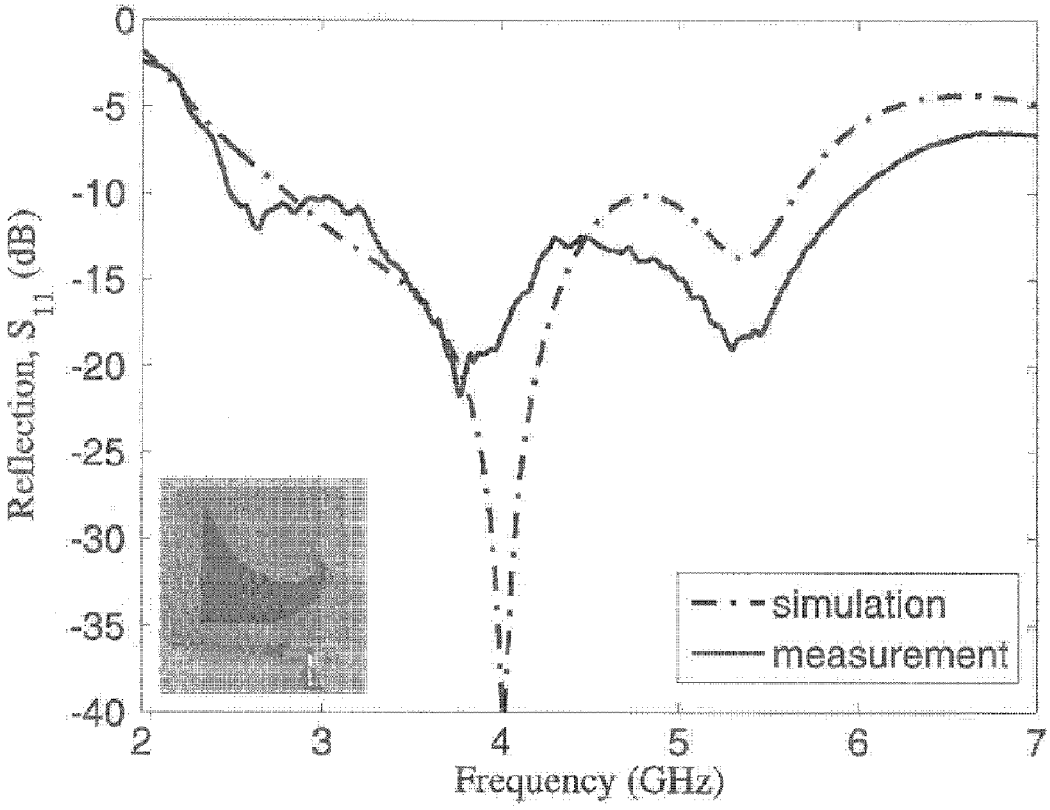
FIG. 4 illustrates the reflection loss properties of a spidron fractal structure of a broadband circularly-polarized antenna in accordance with an embodiment of the present invention.

FIG. 4 illustrates the reflection loss properties of a spidron fractal structure of a broadband circularly-polarized antenna according to an embodiment of the present invention. Referring to FIG. 4, it can be seen that the measured result and its simulation result are very similar to each other, and in the measured result, it can be seen that 78.3% (2580~5900 MHz) of the bandwidth has reflection loss of −10 dB or less.

Figure 5:
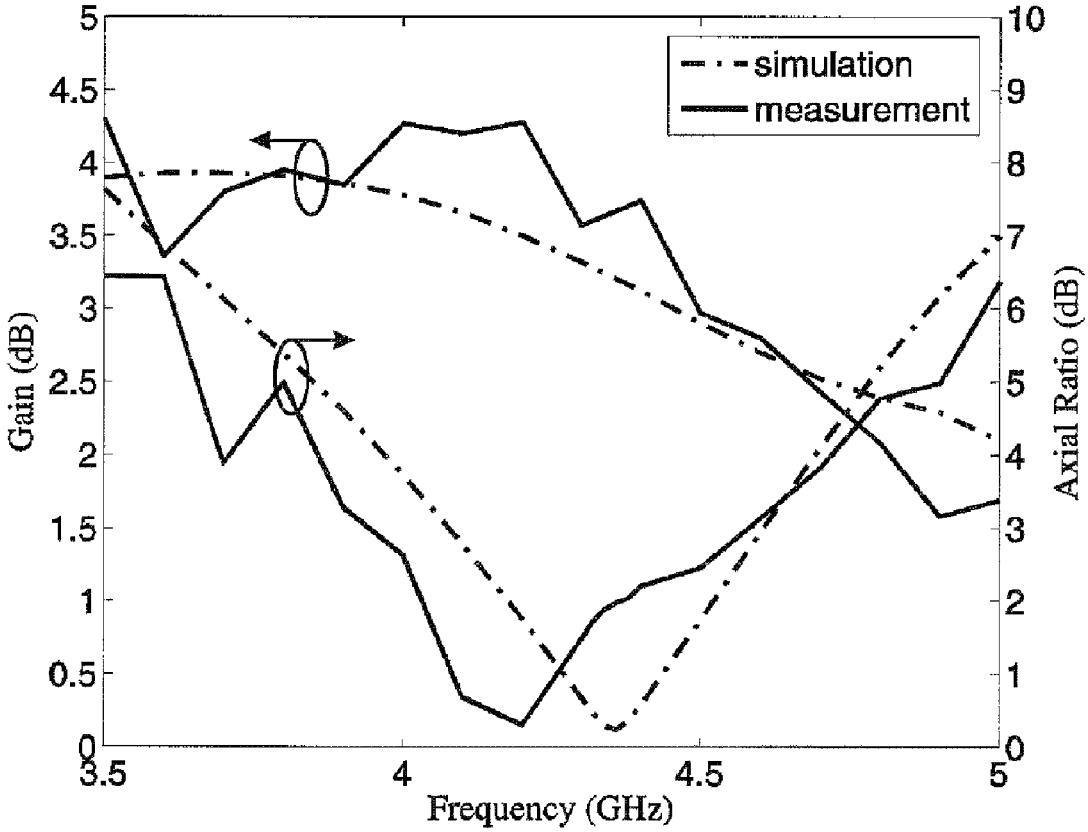
FIG. 5 is a graph that illustrates gain variation in the axial ratio and frequency of a spidron fractal structure of a broadband circularly-polarized antenna in accordance with an embodiment of the present invention.

FIG. 5 is a graph that illustrates gain variation in the axial ratio and frequency of a spidron fractal structure of a broadband circularly-polarized antenna in accordance with an embodiment of the present invention. In the measured result with reference to FIG. 5, it can be seen that 15.2% (3940~4590 MHz) of the circularly-polarized wave bandwidth has an axis ratio of 3 dB or less and that the circularly-polarized wave bandwidth is narrower than the −10 dB overrating bandwidth of the antenna.

Referring to FIG. 5, it can also be seen that the peak gain is 4.3 dBi at 4.2 GHz and that the gain variation is less than 1.4 dBi within a bandwidth of 3 dB in axial ratio.

Figure 6:
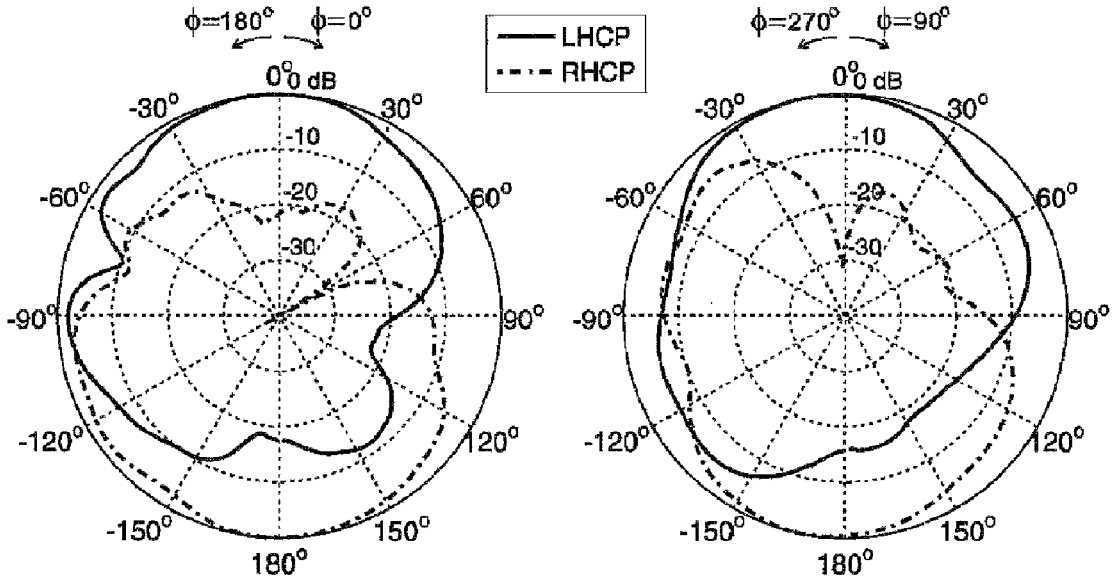
FIG. 6 illustrates radiation patterns on the x-z plane and the y-z plane that are measured at 4.3 GHz for a spidron fractal structure of a broadband circularly-polarized antenna in accordance with an embodiment of the present invention.

FIG. 6 illustrates radiation patterns on the x-z plane and the y-z plane that are measured at 4.3 GHz as to a spidron fractal structure of a broadband circularly-polarized antenna in accordance with the present invention.

Referring to FIG. 6, it can be seen that a right-hand side circular-polarized wave (RHCP) is greater than a left-hand side circular-polarized wave (LHCP) in the negative direction of z-axis. Conversely, the left-hand side circular-polarized wave (LHCP) is greater than the right-hand side circular-polarized wave (RHCP) in the positive direction of z-axis by a 20 dB or more.

As described above, the broadband antenna of the present invention can realize a bandwidth exceeding 70% without using a multilayer substrate to implement the broadband properties, by forming a geometric structure of a slot, i.e., a spidron fractal, which has not been used in the conventional antennas, on the ground surface of the antenna.

The present invention can also induce the radiation properties of a circularly-polarized wave from the properties of the spidron fractal shape, without employing an additional secondary circuit such as a phase distribution circuit for implementing the circularly-polarized wave.

Due to such properties described above, the present invention can implement a small broadband circularly-polarized antenna that costs less to manufacture.

While the spirit of the present invention has been described in detail with reference to a particular embodiment, the embodiment is for illustrative purposes only and shall not limit the present invention. It is to be appreciated that those skilled in the art can change or modify the embodiment without departing from the scope and spirit of the present invention.

As such, many embodiments other than that set forth above can be found in the appended claims.

What is claimed is:

1. A broadband circularly-polarized antenna comprising:

a dielectric substrate;

a ground surface formed on an upper part of the dielectric substrate;

a slot in the shape of a spidron fractal, the slot formed in the ground surface; and a microstripline configured to feed the spidron fractal slot of the ground surface through the substrate, wherein the slot in the shape of the spidron fractal is structured in such a way that a same isosceles triangle is repeatedly coupled to another at least twice.

2. The broadband circularly-polarized antenna of claim 1, wherein the slot in the shape of the spidron fractal is formed in such a way that a reduction ratio of each isosceles triangle forming the spidron fractal shape is $1/\sqrt{3}$.

3. The broadband circularly-polarized antenna of claim 1, wherein a height of the microstripline is 23 unit lengths, and a distance between a center of the microstripline and a point at which a vertex of a first isosceles triangle and a vertex of a second isosceles triangle meet each other is 17 unit lengths, the first isosceles triangle and the second isosceles triangle forming the spidron fractal.

4. The broadband circularly-polarized antenna according to claim 3, wherein the unit length is expressed in millimeters (mm).

5. The broadband circularly-polarized antenna of claim 1, wherein the ground surface is formed in the shape of a square, one side of which is 40 unit lengths, and a width of the microstripline is 3.4 unit lengths.

6. The broadband circularly-polarized antenna according to claim 5, wherein the unit length is expressed in millimeters (mm).

* * * * *